US005471755A

United States Patent [19]

Haskell

[11] Patent Number: 5,471,755

[45] Date of Patent: Dec. 5, 1995

[54] HAND PROTECTION DEVICE

[76] Inventor: Arlene C. Haskell, R.F.D. 1, Box 905, Wells, Me. 04090

[21] Appl. No.: 320,760

[22] Filed: Oct. 11, 1994

[51] Int. Cl.[6] ..... B43L 7/00; B43L 13/00

[52] U.S. Cl. ..... 33/485; 33/492

[58] Field of Search ..... 30/286, 295; 83/DIG. 1; 33/483, 484, 485, 486, 487, 488, 489, 490, 491, 492, 493, 494; D10/71

[56] References Cited

U.S. PATENT DOCUMENTS

| | | | |
|---|---|---|---|
| 287,480 | 10/1883 | Smith | 33/483 |
| 305,665 | 9/1884 | Castles | 33/485 |
| 740,841 | 10/1903 | Kastmann | D10/71 |
| 781,117 | 1/1905 | Willits | 33/492 |
| 963,001 | 6/1910 | Dibrell | 33/485 |
| 2,634,504 | 4/1953 | Jennings, Jr. | D10/71 |
| 3,087,250 | 4/1963 | Blue | 33/484 |
| 3,406,456 | 10/1968 | Schleich | 33/492 |
| 3,678,586 | 7/1972 | Weber | 33/527 |
| 4,024,831 | 5/1977 | Sperling | 33/493 |

*Primary Examiner*—Wiliam A. Cuchlinski, Jr.
*Assistant Examiner*—G. Bradley Bennett
*Attorney, Agent, or Firm*—William Nitkin

[57] ABSTRACT

A hand protection device formed of a single piece of clear plastic material forming a base portion, the front end of which is bent upwardly and rearwardly at 45 degrees thereto to form a shield portion with the the top of the shield portion bent downwardly and rearwardly toward the base portion at a 90 degree angle to form a hand retainer portion, such device for receipt of a user's hand therein.

3 Claims, 4 Drawing Sheets

HAND PROTECTION DEVICE

BACKGROUND OF THE INVENTION

1. Field of the Invention

The device of this invention resides in the area of structures to protect a user's hand and more particularly relates to a device to prevent a user's hand, when holding down fabric, from being accidentally cut by a sharp tool held in the user's other hand when cutting through such fabric.

2. Description of the Prior Art

In quiltmaking many similar-shaped pieces of fabric need to be cut before they are sewed together in a desired quilt pattern. In order to save time a quilter will often cut through many layers of fabric using a ruler as a guide to precisely cut the desired shape. Cutting through layers of fabric is frequently accomplished with a razor knife or a circular razor knife. In the cutting process a single layer or multiple layers of fabric can be placed on a flat surface. Often a ruler is placed over the fabric to be cut which is held down by the user with one hand while the other hand holding a cutter, such as a razor knife, runs the knife along the edge of the ruler through a single or multiple layers of such fabric to cut the desired pieces. Many times, though, the razor will accidentally stray and will strike the hand holding down the ruler, causing a serious cut.

SUMMARY OF THE INVENTION

It is an object of this invention to provide a hand protection device to shield the user's hand which holds down a ruler on fabric as the other hand utilizes a fabric cutter to cut through such fabric along the edge of such ruler. Although the device of this invention is described primarily herein as being useful in quiltmaking, it can be used as a hand protection device in other occupations as well.

The device of this invention can be made of a unitary, stiff, planar member of transparent plastic which is approximately 9 inches in length in a preferred embodiment. The device consists of three portions: a base portion, a shield portion and a hand retainer portion. The base portion is a flat portion on which the user's non-cutting hand is placed. Adjacent to, and contiguous with, the front end of the base portion is the shield portion which is bent upwards and rearwardly at a first edge at approximately a 45 degree angle and extends a distance to a second edge wherein the member is bent downwardly and rearwardly at approximately a 90 degree angle a distance to form the hand retainer portion. The area encompassed by the interior surfaces of the base portion, the shield portion and the hand retainer portion forms a hand retainer area for receipt of the user's non-cutting hand therein. By the user inserting his/her non-cutting hand within the hand retainer area of the device, the user can easily and smoothly maneuver the device in any direction above the ruler where the cutting takes place, and the hand therein is shielded from the razor by the device of this invention. The hand retainer portion in conjunction with the shield portion retains the device securely on the user's hand as the hand moves the device to new positions on the fabric as described below.

DESCRIPTION OF THE PREFERRED EMBODIMENT(S)

Figure 1:
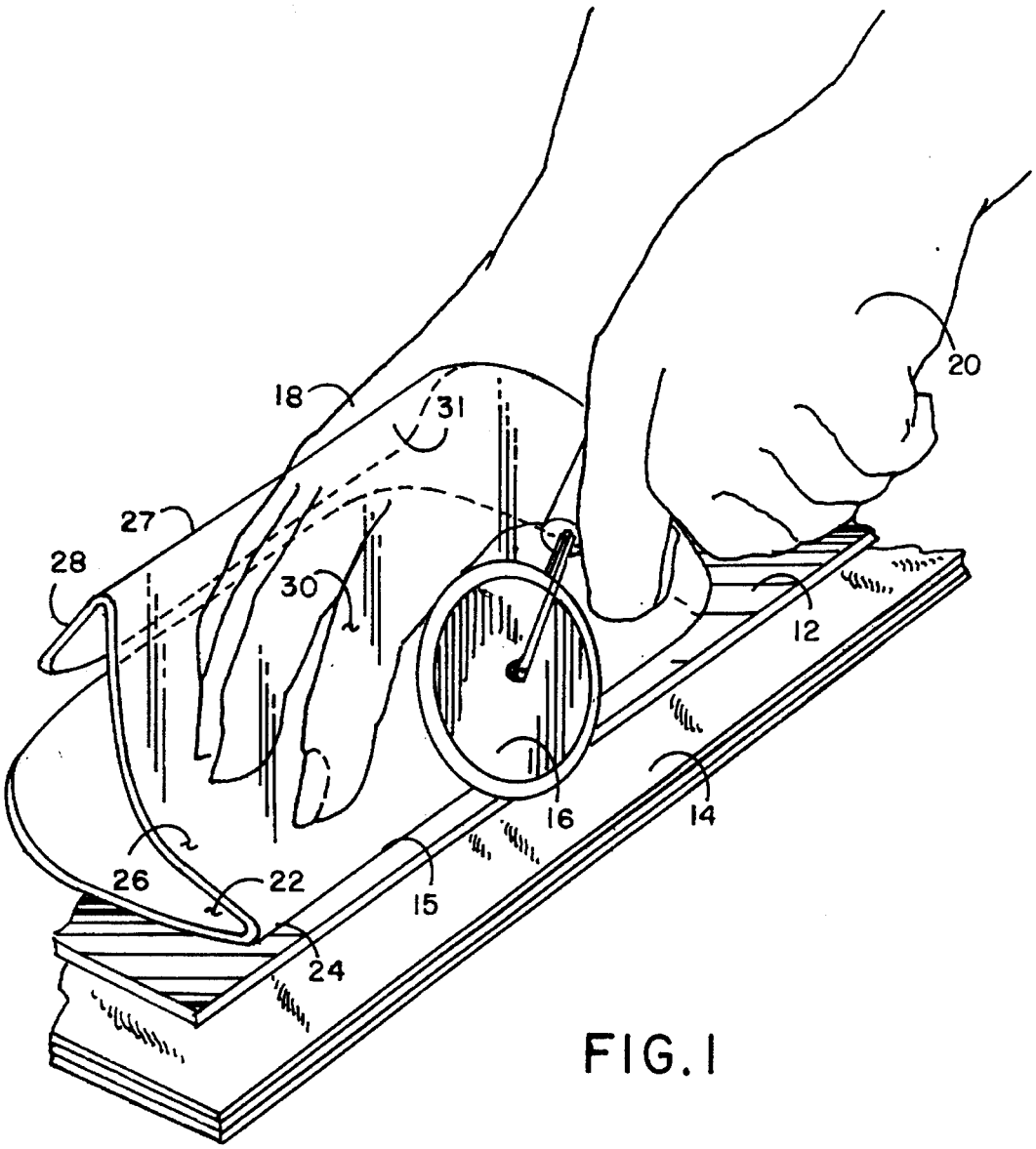
FIG. 1 illustrates a perspective view of the hand protection device of this invention in use positioned on top of a quilting ruler which, in turn, rests on layers of fabric which layers are being cut by a circular razor knife.
Figure 5:
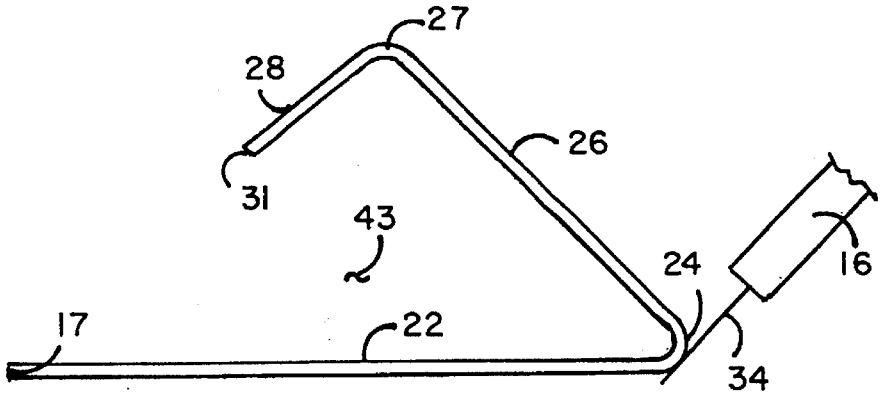
FIG. 5 illustrates a left side elevational view of the device of this invention.
Figure 7:
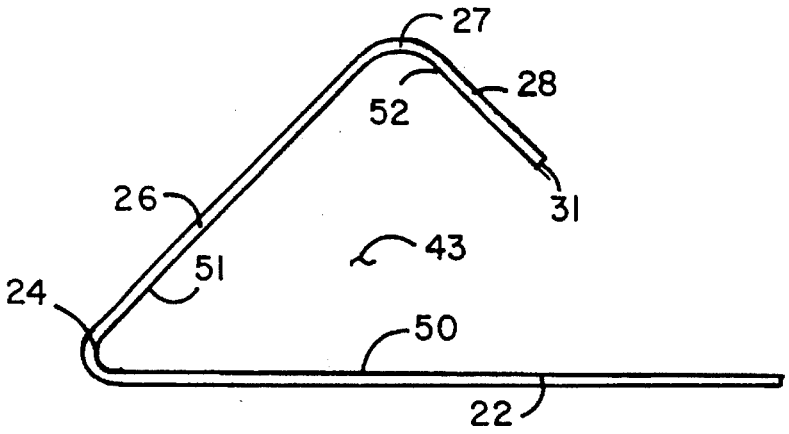
FIG. 7 illustrates a right side elevational view of the device of this invention.

FIG. 1 illustrates the hand protection device 30 of this invention in use with the user's retention hand 18 being positioned therein in hand retainer area 43 formed by first, second and third interior surfaces of the device as seen in FIG. 7. Device 30 is positioned over ruler 12 which can be a quilting ruler which, in turn, is positioned on top of one or more layers of fabric 14. When the device is in use, downward pressure is exerted on base portion 22 to hold the device on top of ruler 12. The device is used to avoid accidental cuts to hand 18 from razor knife 16. A cutter, such as razor knife 16, is held in the user's cutter-holding hand 20 and can be run along the edge of ruler 12 to cut through fabric 14 to create pieces of any desired length. In some instances knife 16 can be run along first edge 24 as seen in FIG. 5.

In a preferred embodiment the device can be formed of a unitary planar member of rigid, clear plastic having a first end and a second end, the distance between the first end and second end being approximately 9 inches in length. The device can also be made of component parts for each portion. First end 17 forms the rear end of base portion 22. At the front end 15 of base portion 22 is first edge 24 where the planar member bends upwardly and rearwardly at approximately a 45 degree angle to form shield portion 26. Shield portion 26 is bent at second edge 27 downwardly and rearwardly at an angle of approximately 90 degrees to form a hand retainer portion which terminates at second end 31 of the device. In a preferred embodiment base portion 22 can be approximately 4.5 inches in length shield portion 26, approximately 3.5 inches in length; and hand retainer portion 28, approximately 1 inch in length. These dimensions provide sufficient interior area to firmly rest the user's hand on base portion 22 to securely hold the device in position on the ruler and to allow the hand retainer portion 28 and shield portion 26 to securely engage the user's hand when the user desires to move the device from place to place. It should be appreciated that these dimensions can vary depending upon the size of the hand to be placed within the device of this invention.

The device can be used with either the right hand or left hand. Because the device is transparent, the user can see the markings on the ruler or details of the fabric that are positioned therebelow to help make determinations of where a cut should be made.

Figure 2:
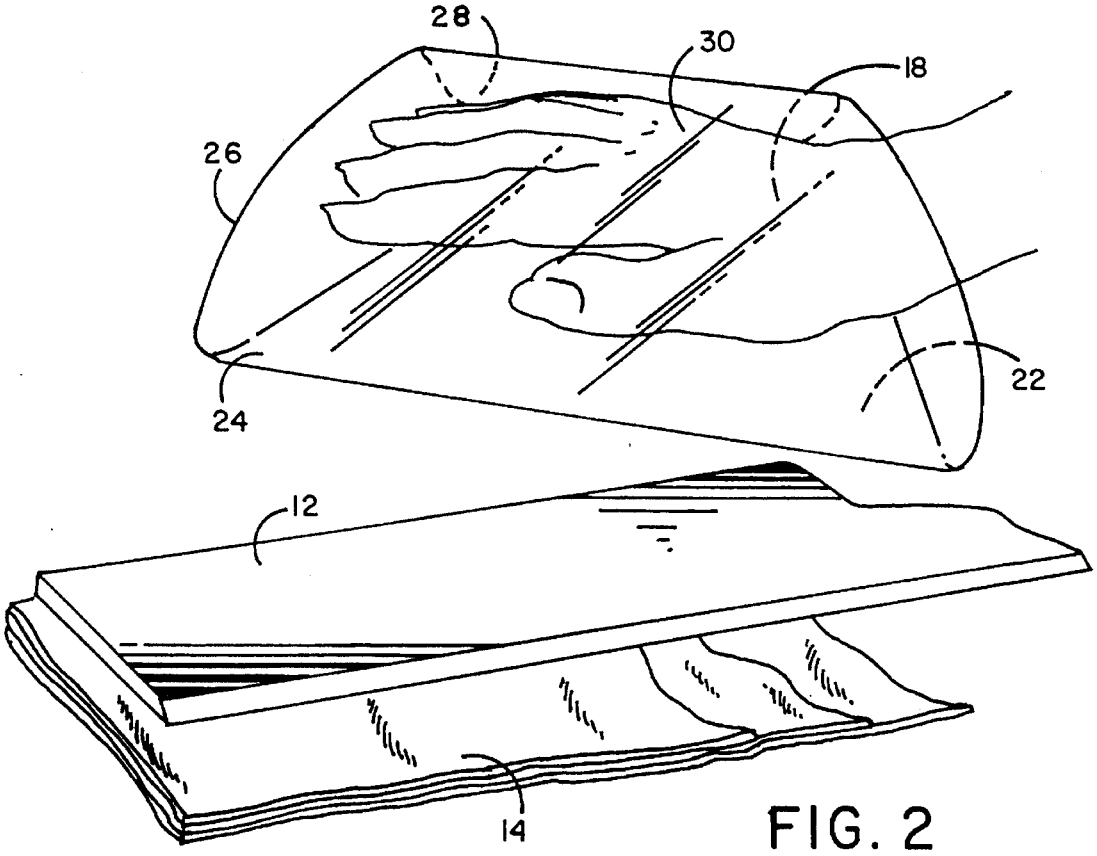
FIG. 2 illustrates a perspective view of the user's hand engaged within the hand retainer portion and shield portion of the device, lifting the device off the ruler above the cut fabric.

FIG. 2 illustrates retention hand 18 of the user lifting the device 30 up from ruler 12 away from layers of fabric 14 such that the device is retained on hand 18 by the angle formed by shield portion 26 and hand retainer portion 28. Base portion 22 is seen under hand 18, and curved first edge 24 is also seen in this view.

Figure 3:
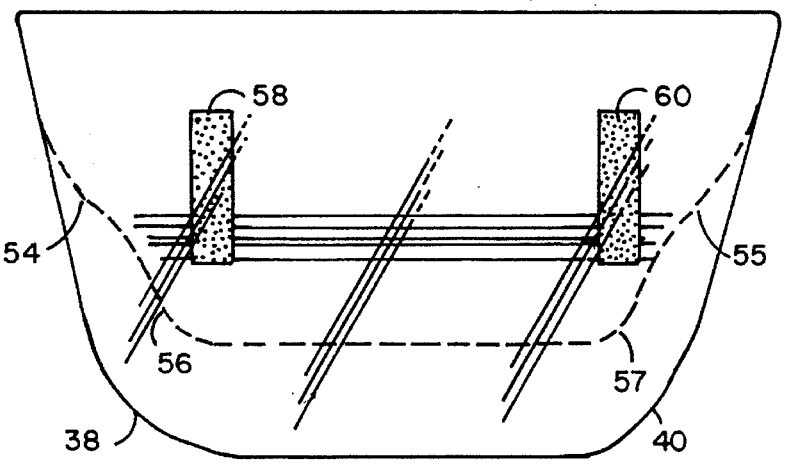
FIG. 3 illustrates a bottom plan view of the device of this invention.

FIG. 3 illustrates a bottom view of a typical structure of this invention showing base portion 22 having first and second curved sides 38 and 40. Also seen are first and second curved sides 54 and 55 of shield portion and first and second curved sides 56 and 57 of hand retainer portion 28. In some embodiments the device of this invention can be provided with a non-slip slip bottom surface such as by providing a segment of non-slip, high-friction tape thereon or roughened area(s) 58 and 60 as seen on the bottom of base portion 22 in FIG. 3 or by equivalent means to retain the fabric or ruler more securely under the device of this invention.

Figure 4:
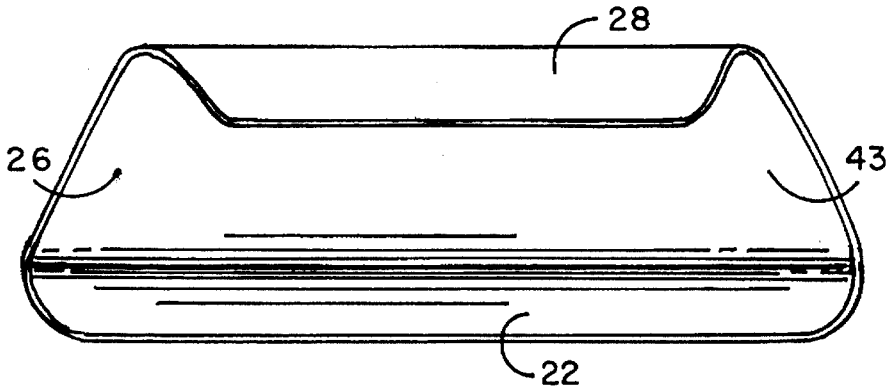
FIG. 4 illustrates a rear elevational view of the device of this invention.

FIG. 4 illustrates a rear view of the device of this invention showing hand retention area 43 in which hand 18 is positioned when the device is in use and retainer portion 28 and shield portion 26 which will engage hand 18 when hand 18 moves the device of this invention from place to place.

FIG. 5 illustrates a left side view of the device which figure corresponds to FIG. 7 which shows a right side view. Also shown are base portion 22, shield portion 26, second edge 27, hand retainer portion 28, first edge 24 with blade 34 of razor knife 16 positioned at an angle thereunder. The curvature of first edge 24 allows blade 34 of razor 16 in some instances to be positioned at an angle extending under first edge 24, as seen in FIG. 5, should a cut line need to be followed in such area.

Figure 6:
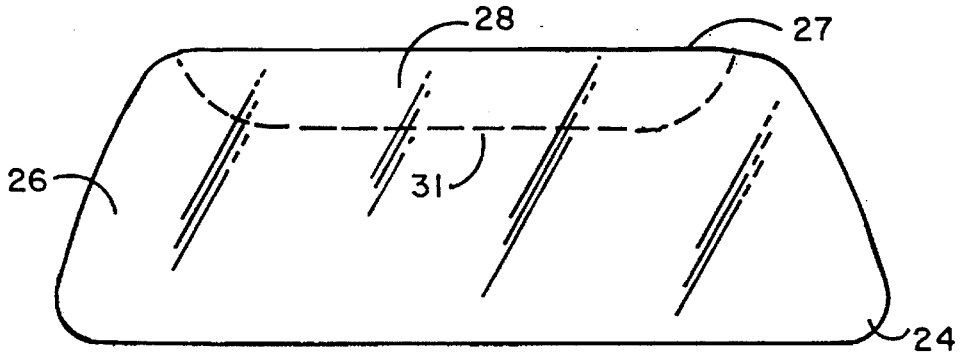
FIG. 6 illustrates a front elevational view of the device of this invention.

FIG. 6 illustrates a front view of the device showing the outer surface of shield portion 26, hand retainer portion 28 and second end 31 indicated by dotted lines.

FIG. 7 illustrates a right side view of the device of this invention showing first interior surface 50 of base portion 22, second interior surface 51 of shield portion 26, and third interior surface 52 of hand retainer portion 28. Also shown is hand retention area 43.

Figure 8:
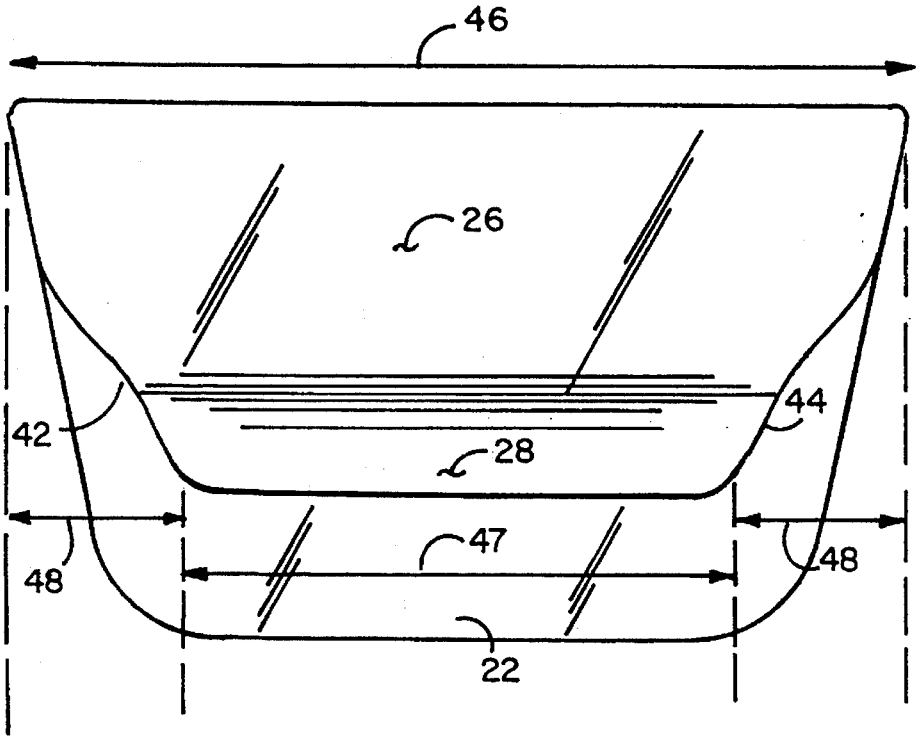
FIG. 8 illustrates a top plan view of the device of this invention showing the curved side edges of the device.

FIG. 8 illustrates a top view of the device showing the structure of hand retainer portion 28, shield portion 26 and base portion 22. Seen in this view are first and second curved sides 42 and 44 of hand retainer portion 28 which narrow the width 47 of hand retention portion 28 in comparison to the width 46 of base portion 22 along first edge 24 to define the amount 48 of curve on each side therebetween to allow for easy bending of the user's wrist beyond first and second curved sides 42 and 44. As discussed above, the three portions of the device of this invention can have their sides curved if desired. The sides of the base portion and shield portion can be curved so that they will not dig into the user's hand which comes in from one end of the device of this invention.

Although the present invention has been described with reference to particular embodiments, it will be apparent to those skilled in the art that variations and modifications can be substituted therefor without departing from the principles and spirit of the invention.

I claim:

1. A hand protection device for receipt of a user's hand, comprising:

an unitary planar transparent member having a first end and a second end defining a length thereof therebetween, said member having a flat base portion having a first side and a second side and a front end and a rear end, said front end and said rear end defining the length of said base portion, said rear end corresponding to said first end, said front end of said base portion being bent upwardly and rearwardly forming a first edge at approximately a 45 degree angle to said base portion to form a planar shield portion, said shield portion having a first side and a second side, said shield portion extending a distance from said first edge to form a second edge and being bent at said second edge toward said base portion at approximately a 90 degree angle to said shield portion to form a hand retainer portion, said hand retainer portion having a first side and a second side, said hand retainer portion extending downwardly and rearwardly at said second edge a length being the distance between said second edge and said second end of said member, said portions of said member each having an inner surface and an outer surface, said inner surfaces of said portions of said member encompassing a hand retention area defined therein for receipt of said user's hand therein.

2. The device of claim 1 wherein said member is approximately 9 inches in length, said base portion being approximately 4.5 inches in length, said shield portion being approximately 3.5 inches in length, and said hand retainer portion being approximately 1 inch in length,

3. The device of claim 1 wherein said first and second sides of said base portion, said first and second sides of said shield portion and said first and second sides of said hand retainer portion are each formed in an inward curve.

* * * * *